US007998004B2

(12) United States Patent
Klein

(10) Patent No.: US 7,998,004 B2
(45) Date of Patent: Aug. 16, 2011

(54) REAL-TIME WIRELESS SENSOR SCORING

(76) Inventor: William M. Klein, Los Altos Hills, CA (US)

( * ) Notice: Subject to any disclaimer, the term of this patent is extended or adjusted under 35 U.S.C. 154(b) by 412 days.

(21) Appl. No.: 12/359,075

(22) Filed: Jan. 23, 2009

(65) Prior Publication Data

US 2009/0191988 A1 Jul. 30, 2009

Related U.S. Application Data

(60) Provisional application No. 61/023,407, filed on Jan. 24, 2008.

(51) Int. Cl.
*A63B 71/06* (2006.01)

(52) U.S. Cl. ..... 473/480; 473/476

(58) Field of Classification Search ..... 473/476, 473/479–480, 485; 340/323 R; 700/92
See application file for complete search history.

(56) References Cited

U.S. PATENT DOCUMENTS

| | | | | |
|---|---|---|---|---|
| 3,137,503 | A | 6/1964 | Ballard | 273/375 |
| 4,904,981 | A | 2/1990 | Mele et al. | 340/323 R |
| 4,999,603 | A | 3/1991 | Mele et al. | 340/323 R |
| 5,039,977 | A | 8/1991 | Mele et al. | 340/323 R |
| 5,364,091 | A | 11/1994 | Sebek | 473/433 |
| 5,365,427 | A | 11/1994 | Soignet et al. | 473/448 |
| 5,372,365 | A | 12/1994 | McTeigue et al. | 473/409 |
| 5,418,517 | A | 5/1995 | Matherne et al. | 340/323 R |
| 5,446,701 | A | 8/1995 | Utke et al. | 367/118 |
| 5,553,846 | A | 9/1996 | Frye et al. | 273/26 C |
| 5,560,617 | A | 10/1996 | Liang | 273/376 |
| 5,636,146 | A | 6/1997 | Flentov et al. | 364/569 |
| 5,684,453 | A | 11/1997 | Welch | 473/447 |
| 5,720,200 | A | 2/1998 | Anderson et al. | 73/172 |
| 5,776,018 | A * | 7/1998 | Simpson et al. | 473/433 |
| 5,813,928 | A | 9/1998 | Hsieh | 473/480 |
| 5,960,380 | A | 9/1999 | Flentov et al. | 702/178 |
| 6,266,623 | B1 | 7/2001 | Vock et al. | 702/44 |
| 6,280,352 | B1 | 8/2001 | Coffeen et al. | 473/447 |
| 6,299,555 | B1 | 10/2001 | Zhao | 473/479 |
| 6,323,932 | B1 | 11/2001 | Zhang et al. | 349/155 |
| 6,389,368 | B1 * | 5/2002 | Hampton | 702/179 |
| 6,418,179 | B1 * | 7/2002 | Shieh | 377/5 |
| 6,496,787 | B1 | 12/2002 | Flentov et al. | 702/150 |
| 6,498,994 | B2 | 12/2002 | Vock et al. | 702/44 |
| 6,499,000 | B2 | 12/2002 | Flentov et al. | 702/178 |
| 6,516,284 | B2 | 2/2003 | Flentov et al. | 702/142 |
| 6,539,336 | B1 | 3/2003 | Vock et al. | 702/182 |
| 6,582,329 | B1 * | 6/2003 | Cabrera | 473/480 |

(Continued)

OTHER PUBLICATIONS

International Search Report and Written Opinion mailed Nov. 15, 2007 in connection with PCT Application No. PCT/US07/60482, 10 pages.

*Primary Examiner* — Dmitry Suhol
*Assistant Examiner* — Alex F. R. P. Rada, II
(74) *Attorney, Agent, or Firm* — Flieser Meyer LLP

(57) ABSTRACT

A shooting sports measurement system to use with a hoop comprises a net including a first sensor suspended within the net and connectable with the hoop to detect vibration transmitted through one or both of the net and the hoop and a second sensor to detect one or both of motion of the net and pressure from a passing object. The shooting sports measurement system further comprises a console communicatively coupled with the first sensor and the second sensor to receive data and calculate results.

20 Claims, 2 Drawing Sheets

U.S. PATENT DOCUMENTS

| | | | | |
|---|---|---|---|---|
| 6,611,782 | B1 | 8/2003 | Wooster et al. | 702/149 |
| 6,758,769 | B2 * | 7/2004 | Nelson | 473/480 |
| 6,813,586 | B1 | 11/2004 | Vock et al. | 702/166 |
| 6,825,777 | B2 | 11/2004 | Vock et al. | 340/870.05 |
| 6,856,934 | B2 | 2/2005 | Vock et al. | 702/149 |
| 6,881,161 | B2 | 4/2005 | Heflin, Sr. | 473/448 |
| 6,885,971 | B2 | 4/2005 | Vock et al. | 702/182 |
| 6,959,259 | B2 | 10/2005 | Vock et al. | 702/142 |
| 6,963,818 | B2 | 11/2005 | Flentov et al. | 702/142 |
| 6,984,129 | B1 * | 1/2006 | Jordan | 434/248 |
| 7,054,784 | B2 | 5/2006 | Flentov et al. | 702/149 |
| 7,072,789 | B2 | 7/2006 | Vock et al. | 702/141 |
| 7,092,846 | B2 | 8/2006 | Vock et al. | 702/182 |
| 7,094,164 | B2 | 8/2006 | Marty et al. | 473/416 |
| 7,162,392 | B2 | 1/2007 | Vock et al. | 702/182 |
| 7,171,331 | B2 | 1/2007 | Vock et al. | 702/160 |
| 7,182,704 | B2 | 2/2007 | Levy | 473/415 |
| 2001/0034583 | A1 | 10/2001 | Flentov et al. | |
| 2001/0037179 | A1 | 11/2001 | Vock et al. | |
| 2002/0059044 | A1 | 5/2002 | Flentov et al. | |
| 2002/0063775 | A1 | 5/2002 | Taylor | |
| 2002/0077784 | A1 | 6/2002 | Vock et al. | |
| 2002/0079433 | A1 | 6/2002 | Vock et al. | |
| 2002/0116147 | A1 | 8/2002 | Vock et al. | |
| 2002/0140633 | A1 | 10/2002 | Rafii et al. | |
| 2003/0014210 | A1 | 1/2003 | Vock et al. | |
| 2003/0054905 | A1 | 3/2003 | King | |
| 2003/0055595 | A1 | 3/2003 | Flentov et al. | |
| 2003/0073518 | A1 | 4/2003 | Marty et al. | |
| 2003/0076484 | A1 | 4/2003 | Bamji et al. | |
| 2003/0093248 | A1 | 5/2003 | Vock et al. | |
| 2003/0101105 | A1 | 5/2003 | Vock et al. | |
| 2003/0163287 | A1 | 8/2003 | Vock et al. | |
| 2003/0181268 | A1 * | 9/2003 | Nelson | 473/480 |
| 2003/0190981 | A1 | 10/2003 | Walker et al. | |
| 2004/0225467 | A1 | 11/2004 | Vock et al. | |
| 2004/0252007 | A1 | 12/2004 | Lussey et al. | |
| 2005/0012023 | A1 | 1/2005 | Vock et al. | |
| 2005/0021292 | A1 | 1/2005 | Vock et al. | |
| 2005/0038626 | A1 | 2/2005 | Flentov et al. | |
| 2005/0080566 | A1 | 4/2005 | Vock et al. | |
| 2005/0223799 | A1 | 10/2005 | Murphy | |
| 2006/0015287 | A1 | 1/2006 | Vock et al. | |
| 2006/0031039 | A1 | 2/2006 | Flentov et al. | |
| 2006/0143645 | A1 | 6/2006 | Vock et al. | |
| 2006/0235642 | A1 | 10/2006 | Vock et al. | |
| 2006/0259268 | A1 | 11/2006 | Vock et al. | |
| 2006/0265187 | A1 | 11/2006 | Vock et al. | |
| 2009/0111616 | A1 * | 4/2009 | Creelman | 473/415 |

* cited by examiner

REAL-TIME WIRELESS SENSOR SCORING

CLAIM OF PRIORITY

This application claims the benefit of U.S. Provisional Patent Application No. 61/023,407, entitled Real-Time Wireless Sensor Scoring, by William M. Klein, filed Jan. 24, 2008.

BACKGROUND

There is an outstanding need in amateur and professional sports to identify players with the potential for development and to provide measurement and training tools to improve performance of existing players. Nowhere is this more true than in the shooting sports, such as basketball, tennis, hockey, golf and others, in which the outcome of an entire game can be determined by the performance of a single player taking a shot.

Currently, the selection, development, training and evaluation of players is almost completely dependent on the experience and observations of coaches and scouts and based upon observing actual play. These simple methods, however, lack any quantitative measure of shooting proficiency.

DETAILED DESCRIPTION

Embodiments of systems and methods for measuring shot activity in a shooting game in accordance with the present invention can be applied to assess performance of a user. Such systems and methods can comprise sensor technology adapted to communicate with a custom console, a commercially available console, or a generic computer to monitor activity at a target, such as a goal. The ability to determine performance by monitoring activity at the target enables a player and/or coach to assess the player's skill level and improve and maintain skills.

Figure 1:
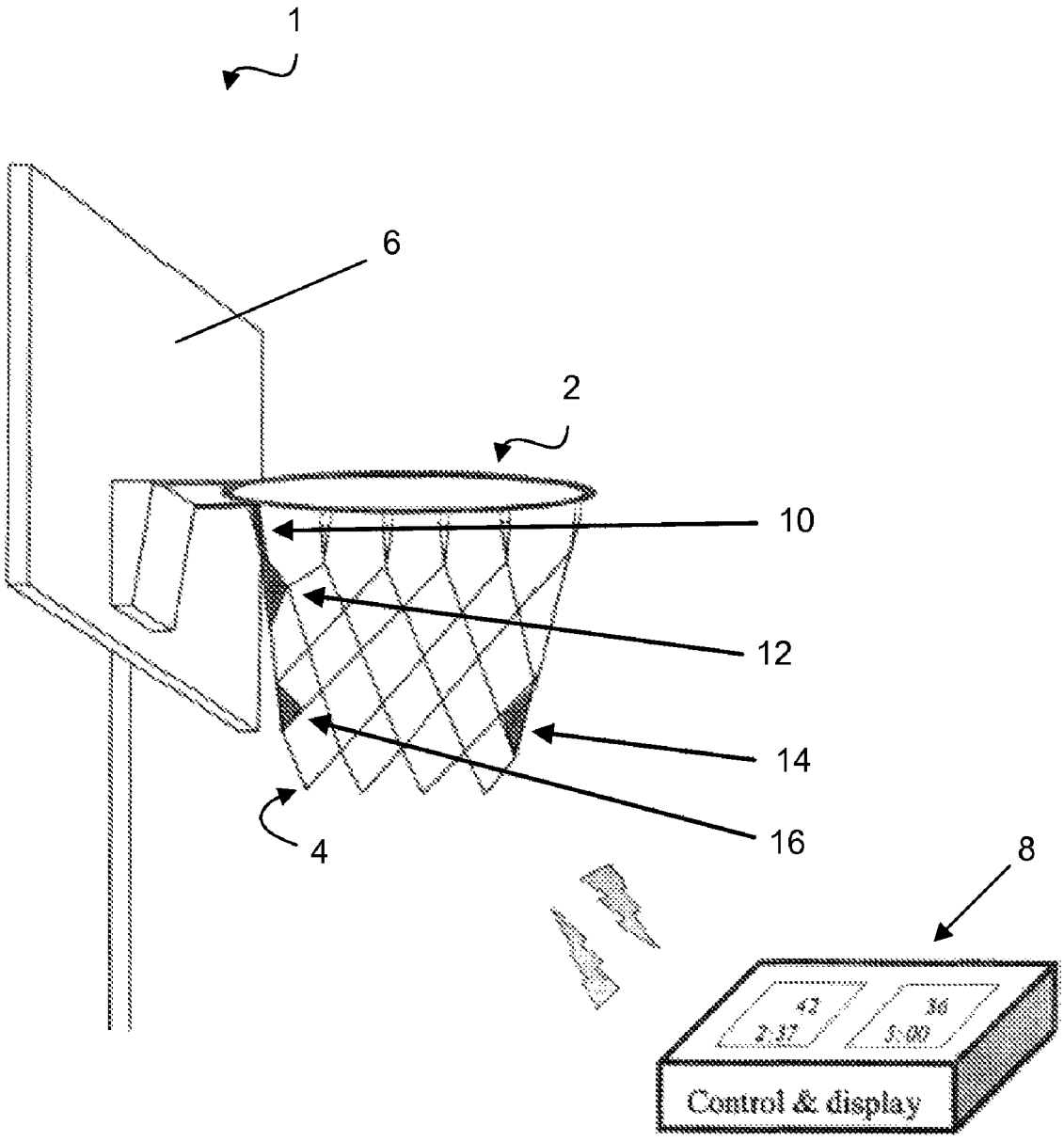
FIG. 1 is simplified illustration of an embodiment of a system for measuring shooting performance in accordance with the present invention.

Referring to FIG. 1, an embodiment of a system 1 in accordance with the present invention is shown comprising a console 8 and a sensor net 4 including a plurality of sensors 12,14,16 residing in the sensor net 4. A goal comprises the sensor net 4 hanging from a hoop 2 mounted to a backboard 6. The backboard 6 and hoop 2 can include commercially available backboards and hoops such as can be found in schoolyard playgrounds, neighborhood facilities, and numerous suburban driveways. A typical basketball hoop is a metal circular rim having a regulation inner diameter (i.e., eighteen inches) and twelve generally evenly-spaced hooks extending from a lower surface of the rim for capturing loops of a net. A typical net for use with the hoop 2 can comprise natural or artificial fibers (e.g., nylon) woven in a diamond or grid structure. The natural or artificial fibers may comprise strands (also referred to herein as strings) having a monofilament or multi-filament structure that is braided or otherwise formed. Alternatively, the strands can refer to other structures combinable to form a net, such as ribbons or tubes. The typical net is suspended from the rim, for example the net can be loosely held in place by a combination of loops built into the hooks and gravity, and is easily removed and replaced, and generally regarded as a consumable to be replaced after weathering and damage.

The sensor net 4 of FIG. 1 can have a diamond structure resembling that of a typical net. There can be two or more sensors 12,14,16 at least one of which can be connected with a printed circuit board (PCB). A sensor PCB can include a processor, sensor signal conditioning capability, and optionally a wireless transmitter or transceiver, for example operating at a radio frequency (RF). The sensors and sensor PCB(s) are fitted within 'diamonds' of the sensor net and may be wired to each other by running wire inside or along the netting, or multiple sensors PCBs may be linked to each other and/or to the console 8 by wireless transmitters or transceivers. Alternatively, some combination of wired and wireless connectivity can be used. For example, to reduce cost, the sensors and multiple sensor PCBs can be connected by wires, with less than all of the sensor PCBs communicating wirelessly with the console 8 by way of a wireless transmitter or transceiver. Sensor technology incorporated in a sensor net can provide ease of retrofitting an existing basketball goal, and reduced cost resulting from compatibility with existing equipment.

In the embodiment illustrated, the sensor net 4 includes a semi-rigid or rigid link 10 connected between the hoop (for example by way of a hook) and an upper rear sensor 12 suspended within the sensor net 4. The semi-rigid or rigid link 10 transfers high-frequency vibrations which would otherwise be filtered out by the low-pass characteristics of the net from the backboard 6 and hoop 2 to the upper rear sensor 12. The upper rear sensor 12 can be a sensor capable of creating a signal in response to acceleration and/or pressure. In an embodiment, the upper rear sensor 12 can comprise a piezo-electric or piezo-resistive accelerometer. One suitable accelerometer is the H48C by Hitachi Ltd. of Japan. Alternatively, piezo beams and discs (i.e., 'benders') can be utilized due to their low cost, simplicity and ruggedness. Piezo beams and disc are low power in that they do not need excitation voltage and can generate adequate output signals in response to mechanical deformation. The semi-rigid or rigid link 10 can comprise a material preferably capable of transferring high-frequency vibrations without excessive dampening of vibration (excessiveness of dampening is dependent on signal conditioning techniques and signal-to-noise ratio requirements). The hoop 2 is typically rigidly mounted with the backboard 6 so that impact of a ball against the hoop 2, the hoop 2 and backboard 6, or only the backboard 6 generates vibrations in the hoop 2 which are transferred to the upper rear sensor 12 by way of the link 10. The upper rear sensor 12 is also adapted to sense net motion, for example when a ball passes through or otherwise contacts the net 4 without contacting the backboard 6 or hoop 2. The upper rear sensor 12 includes an inclusion factor or delay factor to avoid double counting the same shot when multiple triggering events occur. For example, in an embodiment, the upper rear sensor 12 includes a time delay, enabling the upper rear sensor 12 to avoid double counting the same shot from multiple vibrations of the hoop 2 or backboard 6.

The sensor net 4 further includes a lower front sensor 14 and a lower rear sensor 16, both of which sense a combination of net motion and pressure from a passing ball. In an embodiment, the lower front sensor 14 and lower rear sensor 16 can comprise a piezo-electric or piezo-resistive accelerometer. The piezo-based sensors can collect both pressure and acceleration information, with detection of acceleration associated with energetic net motion being sufficient to signify passage of a ball through the net. The mechanical energy "pattern"—e.g., amplitude, frequency, onset and decay information, among others—provides information at each sensor. Additional conclusions can be reached after combining the information from all sensors. For example, sensor height variation within a net causes "delta time" information useful for calculating results regarding a ball's vertical passage. Thus, if the upper rear sensor 12 detects motion followed shortly by detected motion from the lower front sensor 14 and the lower rear sensor 16, a logical conclusion may be drawn by the system 1 that a ball has passed downward through the goal. Contrariwise, if the lower front sensor 14 detects motion followed quickly by detected motion from the lower rear sensor 16, follow thereafter by vibration detected by the upper rear sensor 12, a logical conclusion may be drawn by the system 1 that a ball travelling upward has impacted the sensor net 4 under the hoop 2 and then struck the backboard 6, resulting in an attempted, but missed shot on goal. The system 1 can determine if the ball hit the backboard 6 before the sensor net 4, or vice versa, with sensor "front to back" variation. Further, the system 1 can determine if a ball travelled up or down through the net, with sensor "top-to-bottom" variation. Further, the system 1 can determine the direction of the ball's impact from the initial polarity of an acceleration or pressure waveform.

Sensor characteristics (sensitivity and polarity among others) can be 'learned dynamically' by the system during calibration runs. Information collected from the sensors can be processed by an embedded processor within one or more sensor PCBs and results from the processor(s) can be communicated to the console 8. Alternatively, some or all of the raw data can be communicated to the console 8, which then can then process the raw data to calculate results. Results can include (but are not limited to) an attempted shot on goal and a successful shot on goal.

As mentioned above, wired sensors can be more cost effective than sensors having PCBs with wireless transmitters or wireless transceivers, and therefore redundant sensors can be built into the sensor net, since at a minimum only the wire (connected to an available analog-to-digital converter channel on a sensor processor) and an inexpensive sensor needs to be added. Redundant sensors can be advantageous for extending the lifetime of a sensor net. One or more sensors can fail (depending on the number of redundant sensors) and there can still be enough sensor information to allow the system to function. Redundancy can also be employed when using wireless transmitters and wireless transceivers, but the cost is greater.

In an embodiment, the sensor net 4 can comprise all of the sensors for collecting information needed to assess performance. The system 1 therefore can be used with an existing backboard and hoop setup. The sensor net 4 can include appropriate loops for connecting to the hoop 2. As will be appreciated, such an arrangement makes the system 1 practical for use in nearly any environment. Further, while the sensor net 4 has been described as including a diamond pattern, the sensor net 4 can have some other pattern and/or need not resemble a traditional basketball net. For example, in alternative embodiments, the sensor net can resemble a sleeve having a substantially closed circumferential surface area. Further, typical hoops have been described above as including twelve hooks; however, embodiments of systems in accordance with the present invention can comprise sensor nets configured to connect with any number and type of attachment points on any diameter hoop. For example, the sensor net can include attachment devices that complement attachment devices of the hoop such as clasps, buckles, Velcro or other retainers. Still further, the upper rear sensor need not be arranged at a rear of the hoop, but may be arranged anywhere along the hoop as long as vibration of the hoop is receivable by the upper sensor to produce a usable signal. Still further, while the sensor net has been described as including an upper rear sensor, a lower front sensor, and a lower rear sensor, in other embodiments, the sensor net can include only two sensors (e.g., an upper rear sensor and a lower front sensor, or an upper rear sensor and a lower rear sensor). As will be appreciated, such an arrangement may have inferior results due to a lower amount of available data, but may be suitable for low-cost applications where limited results are acceptable. One of ordinary skill in the art, in light of the teachings contained herein, will appreciate the myriad shapes and sensor arrangement with which the sensor net can be formed.

Referring again to FIG. 1, the console is communicatively coupled with the sensor net to receive data and determine performance of a player based at least in part on the data received. In the embodiment shown, the console comprises a control and display terminal. In other embodiments, the console can be realized using devices capable of at least one-way communication of wireless transmissions from the sensor net. The console may be coupled with the sensor(s) using, for example, one or more of Bluetooth™, wireless fidelity (wi-fi), wireless telephony, and infrared (IR) receivers. (Other communications mechanisms are contemplated as well, and embodiments of systems in accordance with the present invention are not intended to be limited by a particular wireless technology.) Compatible devices therefore may include a cellular telephone, a personal data assistant (PDA), a media player such as an iPod®, a portable video gaming device such as the Nintendo Dual-Screen (DS)® or PlayStation Portable (PSP)®, or the like. For example, the system may be attractive to teenagers who commonly have portable video gaming devices. The system can take advantage of these devices as consoles, and a sensor net can be sold packaged as a game, or alternatively bundled with a PSP® or DS® to encourage sales of the portable video gaming devices and/or the system.

While the lower sensors (front and/or back) have been described as piezo-accelerometers, in other embodiments the lower sensors can comprise some other sensor technology. For example, in an alternative embodiment, a sensor net can include a material that when fixed onto the inside of the net senses a ball passing through the basket by application of pressure on the material. One such material suited to this application is Quantum Tunneling Composites (QTC) material, such as provided by Peratech Ltd., of North Yorkshire. QTC materials are composite materials of metal particulates and non-conducting elastomeric binder, used as pressure sensors. QTC materials operate using quantum tunneling: without pressure, the conductive elements are too far apart to conduct electricity and the "switch" is off; when pressure is applied, they move proportionately closer and electrons can more readily tunnel through the insulator and the "switch" is progressively turned on. Alternatively, the lower sensors can comprise one or more of optical sensors, ultrasonic, e-fields, mechanical alternatives, strain gages and magnetic field sensors or combinations thereof For example, switching devices are disclosed in detail by Lussey et al. in U.S. Pat. Publ. 2004/0252007, incorporated herein by reference. The publication describes a textile comprising a variably resistive element and textile-form members connective to external circuitry. The variable resistive element can act as a switching device responsive to deformation. One or more such switching devices can be employed to send a signal indicating a successful shot in response to mechanical deformation of the net caused as the ball passes through the net. The external circuitry can be connected to the backboard or other structure, for example by way of an adhesive backing, and wire electrically communicating a signal from the one or more such switching devices can be woven and/or threaded through the loops of the sensor net. The sensor net can alternatively include switches that respond to compressive or tensile stress, as desired. One such fabric sensor suited to this application is ElekTex™ available from Eleksen Group, plc of Bucks, United Kingdom. Another such fabric sensor suited to this application is Fibretronic Ltd., of North Yorkshire. Likewise, other sensor technology can be employed to detect vibration in the backboard and/or hoop resulting from a collision of a ball with the backboard and/or hoop.

While the present invention is described herein with reference to example embodiments for measuring basketball players' performance, the present invention is not so limited, and in fact, the real time measurement techniques provided by embodiments of the present invention are broadly applicable to a wide variety of shooting sports. As used herein, the term shooting sports is intended to be broadly construed to include any sport in which a player makes a shot, including without limitation basketball, tennis, hockey, water polo, polo, lacrosse, golf and other shooting sports. Thus, when describing embodiments exemplified by way of basketball, a basket refers to a target and/or gate. In other sports, such a target and/or gate is referred to using a descriptor such as goal for hockey, water polo, polo and lacrosse, hole for golf, or goal post for football, etc.

In addition to sensors included with the sensor net, optionally, additional sensors associated with a player can be added to enhance an experience. For example, a sensor disposed in a player's shoe or article of clothing, may be used, in a simple example, to identify a player and associate information with the player or, in a more complex example, to monitor player physical activity, such as steps taken, calories burned, jumps made, etc. One such device for measuring performance of a wearer by way of footwear is the Nike+™ system available from Nike, Inc. The Nike+™ system employs a sensor placed inside a shoe that broadcasts wirelessly to a complementary receiver connected with an iPod®. The sensor measures and communicates a wearer's pace, performance, etc. Other devices that can provide additional sensors associated with a player or ball can include global positioning system (GPS) devices mounted on individuals or inside a ball, for example, to provide player location and/or ball trajectory information. Devices using similar technology can be employed as an optional enhancement configurable to wirelessly communicate information to the console, whether the console is a dedicated device or some other device such as an iPod®.

Figure 2:
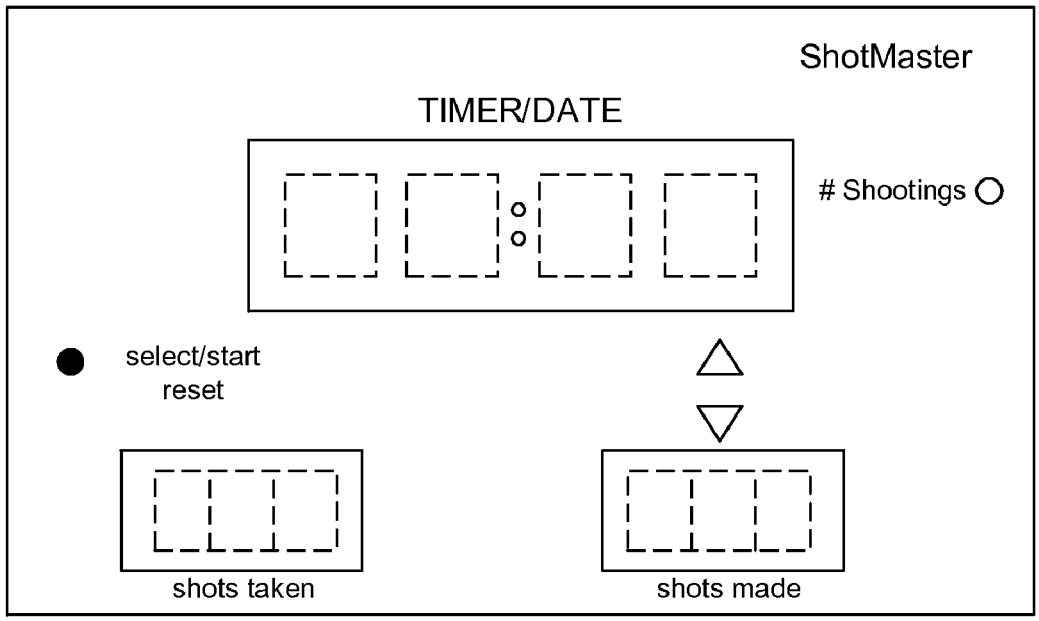
FIG. 2 is a high level overview illustration of an embodiment of a console apparatus for measuring shooting performance in accordance with the present invention.

FIG. 2 is a high level overview of an interface for a dedicated console for measuring shooting performance of an embodiment of the present invention. The console is shown marketed under the name SHOTMASTER™. The console includes a first display area 20 for displaying a clock timer. Optionally, the clock timer can display other information such as date. A second display area 22 shows a number of shots taken, and a third display area 24 shows a number of shots made. A button (also referred to herein as a key) 26 can be provided to start the console, reset the console, and/or provide a select option for toggling through display information (for example, where multiple sessions are recorded). Further, one or more input keys 28 are provided, for example, to set a time on the clock timer, or to program a desired number of shot attempts, etc. Various console embodiments will also include a timer, buzzer and warning device (not shown). The console of FIG. 2 illustrates one embodiment of a console having a relatively simple interface that can provide one or more of the following benefits through simplicity: increased durability, reduced energy consumption (and improved battery life), and reduced cost (to reduce initial investment as well as replacement costs due to impact). In other embodiments, more or fewer display options can be provided, for example commensurate with the results calculated from the information. The dedicated console can be portable or fixed. In some embodiments, the dedicated console can include a clamp-like structure to allow the dedicated console to snap to a pole on which a backboard may or may not be mounted (for example in a schoolyard) or to a wall by adhesives or Velcro (for example in a gym). The console can optionally include electronic interface ports, such as memory card slots for receiving memory cards (e.g., multi-media cards (MMC), memory-sticks) for exporting and/or storing data and results, or a universal serial bus (USB) port for connecting to a personal computer (PC). Data and results can be populated to a database with historical performance data to prepare charts and display graphs. Alternatively, the console 8 can be linked to a computer using some other communications interface.

As mentioned above, optionally the console can exist as a program for a non-dedicated device. For example, the interface above can be simulated in a software program and displayed on a portable gaming system, such as the DS®, or a cellular telephone such as an iPhone®. In the case of the DS® and iPhone®, the touch screen interface can allow a graphically displayed button to act as a functional button. Alternatively, the program can be controlled by depressing keys of the key pad. Using a non-dedicated device running a software program as a console can reduce a number of components that a player or user carries with them, improving portability of the system 1. Further, a user interface can be user customized or selected when contained wholly or partially as a software program. Both of the example non-dedicated devices are capable of receiving wireless-fidelity signals, making them capable candidates for such an implementation.

When implemented in software (e.g. as an application program, object, agent, downloadable, servlet, and so on in whole or part), a learning integration system or other component may be communicated transitionally or more persistently from local or remote storage to memory (SRAM, cache memory, etc.) for execution, or another suitable mechanism can be utilized, and components may be implemented in compiled or interpretive form. Various combinations of raw input data, intermediate data, and the resultant data analysis may further reside more transitionally or more persistently in a storage media, cache or other volatile or non-volatile memory.

Appropriate software coding can readily be prepared by skilled programmers based on the teachings of the present disclosure, as will be apparent to those skilled in the software art. The invention may also be implemented by the preparation of application specific integrated circuits or by interconnecting an appropriate network of conventional component circuits, as will be readily apparent to those skilled in the art.

The present invention can include a computer program product which is a storage medium (media) having instructions stored thereon/in which can be used to program a computer to perform any of the processes of the present invention (e.g., populate a database with results). The storage medium can include, but is not limited to, any type of rotating or non-rotating media including hard disk drives (HDDs), floppy disks, optical discs, digital versatile discs (DVDs), compact disc read-only memory drives (CD-ROMs), solid state drives (SSDs), micro-drives, magneto-optical disks, magnetic or optical cards, nano-systems (including molecular memory integrated circuits (ICs)), or any type of media or device suitable for storing instructions and/or data.

Stored on any one of the storage medium (media), the present invention includes software for controlling both the hardware of the general purpose/specialized computer or microprocessor, and for enabling the computer or microprocessor to interact with a human user or other mechanism utilizing the results of the present invention. Such software may include, but is not limited to, device drivers, interrupt service routines, operating systems, and user applications.

Other features, aspects and objects of the invention can be obtained from a review of the figures and the claims. It is to be understood that other embodiments of the invention can be developed and fall within the spirit and scope of the invention and claims. The foregoing description of preferred embodiments of the present invention has been provided for the purposes of illustration and description. It is not intended to be exhaustive or to limit the invention to the precise forms disclosed. Many modifications and variations will be apparent to the practitioner skilled in the art. The embodiments were chosen and described in order to best explain the principles of the invention and its practical application, thereby enabling others skilled in the art to understand the invention for various embodiments and with various modifications that are suited to the particular use contemplated. It is intended that the scope of the invention be defined by the following claims and their equivalence.

The invention claimed is:

1. A basketball net for use with a basketball hoop, comprising:

a first piezo-accelerometer to detect vibration transmitted through the basketball hoop;

a link connectable between the first piezo-accelerometer and the basketball hoop to conduct vibration of the basketball hoop to the first piezo-accelerometer;

a second piezo-accelerometer arranged below the first piezo-accelerometer to detect one or both of motion of the basketball net and pressure from a passing basketball; and a third piezo-accelerometer arranged below the first piezo-accelerometer and substantially opposite the second piezo-accelerometer to detect motion of the basketball net; and wherein one or more of the first, second and third piezo-accelerometer is mounted on a printed circuit board including a wireless transceiver.

2. The basketball net of claim 1, wherein the first, second, and third piezo-accelerometers are communicatively connected by wires.

3. The basketball net of claim 1, wherein the first, second, and third piezo-accelerometers are each mounted on a printed circuit board including a wireless transceiver; and wherein the first, second, and third piezo-accelerometers are communicatively connected by wireless signals.

4. The basketball net of claim 1, further comprising a web of strings arranged in a diamond pattern; and wherein the first, second, and third piezo-accelerometers are arranged within diamonds of the diamond pattern.

5. The basketball net of claim 4, wherein the first, second, and third piezo-accelerometers are communicatively connected by wires embedded within the strings.

6. A shooting sports measurement system to use with a hoop, comprising:

a net including:

a first sensor suspended within the net;

a semi-rigid or rigid link connected with the first sensor and a first end and connectable with the hoop at a second end to transmit vibration of the hoop to the first sensor; and a second sensor arranged below the first sensor to detect one or both of motion of the basketball net and pressure from a passing object; and a console, the console communicatively coupled with the first sensor and the second sensor to receive data and calculate results.

7. The system of claim 6, wherein the first sensor is one or more of a piezo-electric accelerometer, a piezo-resistive accelerometer, a piezo beam, and a piezo disc.

8. The system of claim 6, wherein the console uses data from the first sensor to detect a shot taken.

9. The system of claim 6, wherein the second sensor comprises one or more of a piezo-electric accelerometer, a piezo-resistive accelerometer, a piezo beam, and a piezo disc.

10. The system of claim 6, wherein the second sensor comprises one or more of a Quantum Tunneling Composites material, an optical sensor, an ultrasonic sensor, an electric field (e-field) sensor, a magnetic field sensor, and a strain gage.

11. The system of claim 6, further comprising a third sensor arranged below the first sensor and substantially opposite the second sensor to detect one or both of motion of the basketball net and pressure from a passing object; and wherein the console is communicatively coupled with the third sensor.

12. The system of claim 6, wherein the third sensor comprises one or more of a piezo-electric accelerometer, a piezo-resistive accelerometer, a piezo beam, a piezo disc, a Quantum Tunneling Composites material, an optical sensor, an ultrasonic sensor, an electric field (e-field) sensor, a magnetic field sensor, and a strain gage.

13. The system of claim 6, wherein the console uses a temporal sequence of data from the first sensor and the second sensor to determine whether the passing object passes through the hoop to indicate a successful shot.

14. The system of claim 6, wherein the console can be calibrated to improve measurements of the shooting sports measurement system.

15. The system of claim 6, wherein the console is an input and output device for each shooting session.

16. The system of claim 6, wherein the console includes a first display for displaying time, a second display for displaying a result, and an RF receiver for receiving a signal from one or both of the first sensor and the second sensor.

17. The system of claim 6, wherein the console is a software program adapted to be executed on a non-dedicated device.

18. The system of claim 6, wherein the first sensor, the second sensor, and the third sensor are communicatively coupled to the console by one or more wireless transmitters.

19. The system of claim 16, wherein the console is executable on one of a cell phone, a personal digital assistant, a watch, a media player, and a personal video game player.

20. A computer based method to measure shooting sports performance, the method comprising:

using a net connected to a hoop, the net including a first sensor suspended within the net, a semi-rigid or rigid link connected with the first sensor and a first end and connected with the hoop at a second end to transmit vibration of the hoop to the first sensor, and a second sensor arranged below the first sensor to detect one or both of motion of the basketball net and pressure from a passing object; and the method further comprising the computer implemented steps of:

determining whether a shot is taken by a player based on vibration sensed by the vibration sensor;

determining whether a shot is made by the player based on one or both of motion of the net and pressure from a passing ball sensed by the motion sensor; and determining performance of the player based on the previous determining steps.

* * * * *